US006594855B2

(12) United States Patent
Tomaschewski

(10) Patent No.: US 6,594,855 B2
(45) Date of Patent: Jul. 22, 2003

(54) ROADWAY CLEANING APPARATUS

(75) Inventor: Karl-Heinz Tomaschewski, Heretsried-Lauterbrunn (DE)

(73) Assignee: Heretsreid-Umwetec GmbH & Co. KG, Lauterbrunn (DE)

( * ) Notice: Subject to any disclaimer, the term of this patent is extended or adjusted under 35 U.S.C. 154(b) by 0 days.

(21) Appl. No.: 09/938,631

(22) Filed: Aug. 27, 2001

(65) Prior Publication Data

US 2002/0023310 A1 Feb. 28, 2002

(30) Foreign Application Priority Data

Aug. 26, 2000 (DE) ..... 100 42 042

(51) Int. Cl.[7] ..... A47L 5/00; A47L 9/02
(52) U.S. Cl. ..... 15/320; 15/387
(58) Field of Search ..... 15/320, 340.1, 15/387, 322, 340.4

(56) References Cited

U.S. PATENT DOCUMENTS 1,069,608 A * 8/1913 Ewing et al. ..... 110/233
5,005,253 A * 4/1991 Noelle et al. ..... 15/340.4
5,826,298 A * 10/1998 Rohrbacher et al. ..... 15/321
5,970,574 A * 10/1999 Thrash, Jr. ..... 15/321
5,991,968 A * 11/1999 Moll et al. ..... 15/322
6,081,960 A * 7/2000 Shook et al. ..... 15/322

FOREIGN PATENT DOCUMENTS

DE 44 04 230 A1 8/1995
EP 0 318 074 B1 4/1991

* cited by examiner

*Primary Examiner*—Terrence R. Till
(74) *Attorney, Agent, or Firm*—Connolly Bove Lodge & Hutz LLP

(57) ABSTRACT

An apparatus for cleaning of a roadway, in particular a starting/landing runway of an airport, comprising distributor devices (13, 14, 18) pivotally arranged on and rotated by a driving shift (6) inside a housing (1) in order to apply a high pressure fluid to a surface to be cleaned. To make it possible to achieve improved cleaning characteristics with a simple and compact construction, inside the housing (1) is deployed a fan wheel (21) driven by a driving shaft (6) of a distributor device (13, 14, 18) to produce low pressure and an air current in the housing (1) for the removal of dissolved dirt via a removal channel (33).

20 Claims, 4 Drawing Sheets

ROADWAY CLEANING APPARATUS

Figure 1:
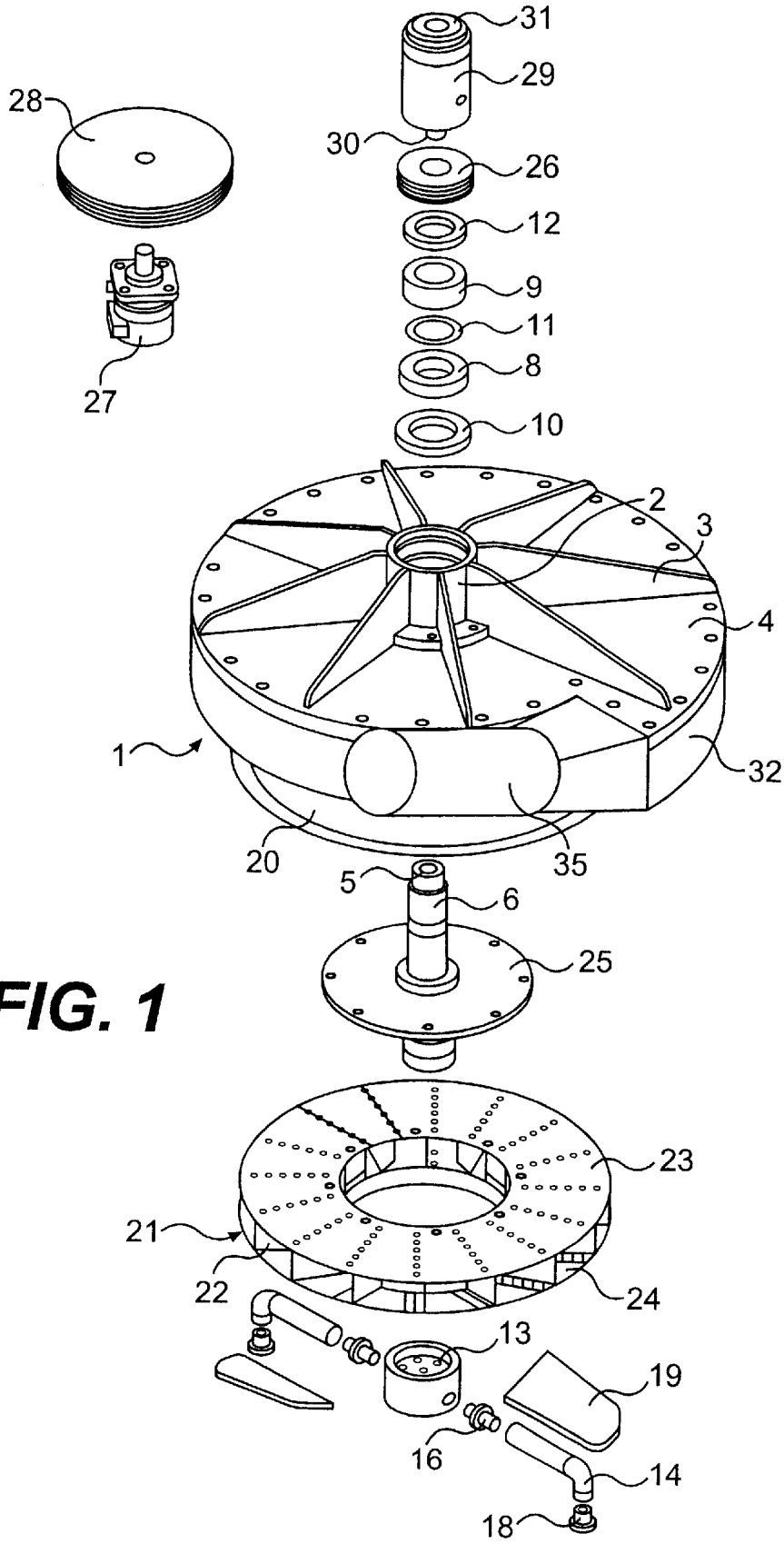

The invention relates to an apparatus for cleaning of a roadway, in particular of a starting/landing runway in an airport in accordance with the main claim of claim 1. The invention relates to a cleaning apparatus which is equipped with one or more such devices.

A strong rubber abrasion is caused by the projecting wheels of a landing aircraft on the starting or landing runway of an airport in the so called touchdown zone. This closes the pores of the coating on the runway and thus exerts an influence on its coefficient of friction as well as its drainage characteristics. Since the coefficient of friction of the runway coating will influence in a major way the touchdown and braking conduct of a landing aircraft, this value is measured several times a day with a special vehicle provided with an integrated measuring system and then communicated to the pilots. When the value is below a predetermined minimum value, it is the duty of the operator of an airport to improve the friction coefficient and to remove the remnants of rubber abrasions. Cleaning is usually performed with a special cleaning apparatus by using water jets under a high pressure.

A cleaning apparatus of this kind is known from EP 0 400 758 B1, wherein a water jet is aimed under a high pressure with a pivotally attached distributor accommodated inside a housing on the surface to be cleaned. In order to prevent damage to the surface, the water jet is moved with a predetermined minimum speed linearly over the surface so that the time period of dwelling in a certain location is reduced. This cleaning apparatus, however, is not provided with any measures for removal or elimination of the dissolved dirt particles from the surface.

DE 295 16 812 U1 discloses a floor cleaning machine provided with a cleaning and/or polishing wheel which is mounted pivoted on the vertical axis in the lower part of a housing. Driving of the cleaning and/or polishing wheel is achieved with an electric motor whose driving shaft is arranged so that is shifted laterally to the rotation axis of the cleaning and/or polishing wheel. In order to prevent escaping of the abrasion remnants or the dirt particles from the lower housing, a suction housing, which provided with a suction pump connected to it via a through opening, is mounted on the lower housing.

The suction pump, however, is equipped with its own driving motor which is separate from the driving operations of the cleaning and/or polishing wheel.

The objective of this invention to provide a cleaning apparatus equipped with cleaning devices of the type mentioned above, which enables improved cleaning with a simple and compact construction.

This objective is achieved with an apparatus and cleaning device that is provided with the characteristics disclosed in claims 1 to 10.

According to the cleaning apparatus of this invention, the distributor, which serves to apply a fluid at a high pressure, for instance water under a high pressure, is integrated with a fan wheel for removal of the dissolved dirt by suction inside a housing, operated so that they are set in motion with a common drive. The water is applied with the rotating motion of the distributor device so that it is uniformly distributed on the surface to be cleaned. Suction is also produced at the same time due to the rotating movement of the fan wheel. This serves to remove the particles separated from the surface as well as the cleaning water from the surface so that they are sucked into the housing and then transported away through a ventilation channel. A particularly effective and efficient cleaning is thus enabled thanks to the separation and removal by suction of the dissolved material, and this can be carried out in one working operation. Since no separate driving motors and corresponding storage areas will be required for the distributor and suction device, the cleaning apparatus can be achieved with very compact and light construction characteristics. Moreover, thanks to a very small number of the driving elements, not only are the costs reduced, but also the expenses related to the assembly or maintenance of the cleaning apparatus are lowered.

Advantageous embodiments and preferable modifications of the invention are further disclosed in dependent claims.

The distributor device is thus provided for example in a particularly advantages embodiment with at least one ventilation baffle. This can be used to produce a reduced pressure on the entire surface to be cleaned.

This reduced pressed lifts the separated particles from the surface and prevents them from being deposited there again. An air current is created by to rotary motion above the ventilation baffle, which transports the lifted particles in the region of the fan wheel. Solid substance particles thus can be picked up in the air and sucked out at the same time already at this point. The additional air current produced in this manner not only contributes to an improved efficiency of cleaning, but it also prevents discharging of water or of a spray fog from the housing.

In an advantageous embodiment from the viewpoint of the construction, the distributor device is provided with a distributor head mounted at the lower end of the driving shaft having a plurality of washing arms, wherein a ventilation guide is mounted on each washing arm.

Figure 2:
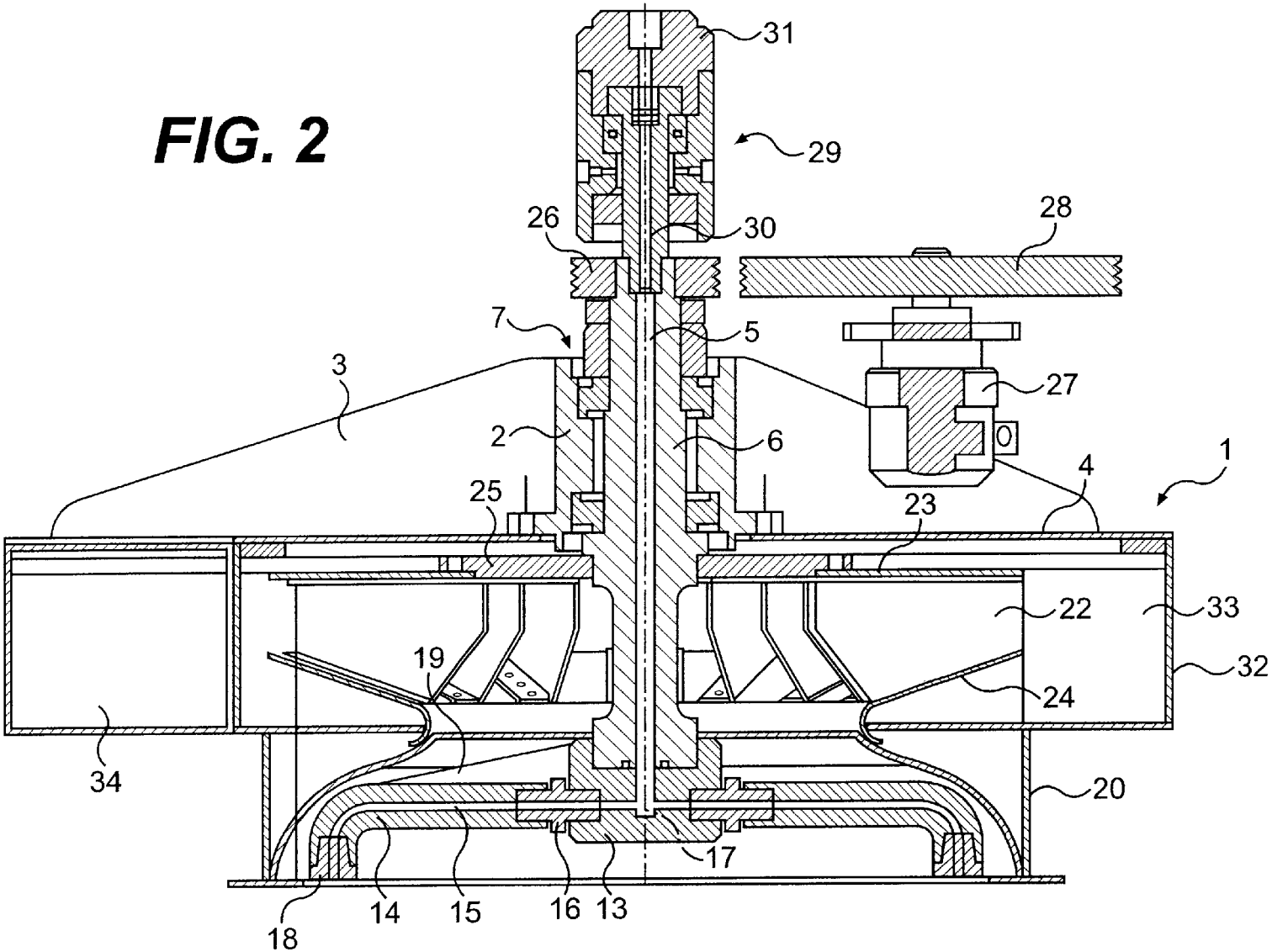
Figure 3:
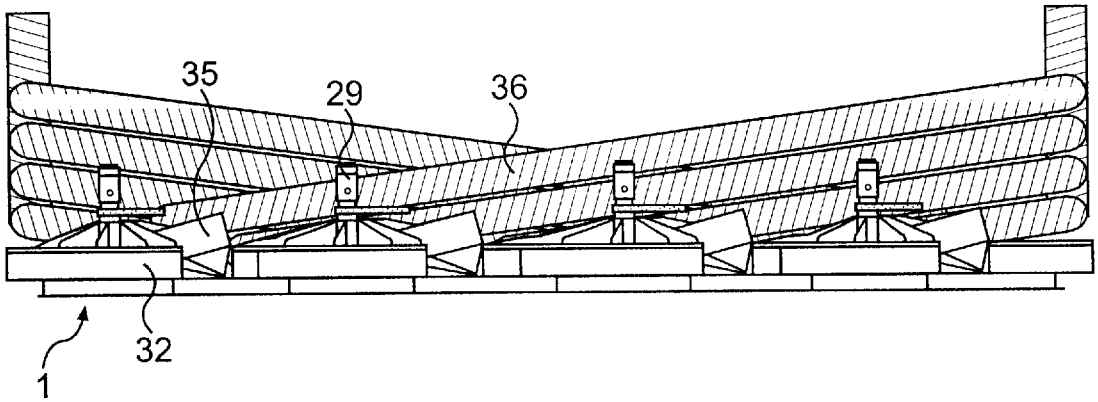
Figure 4:
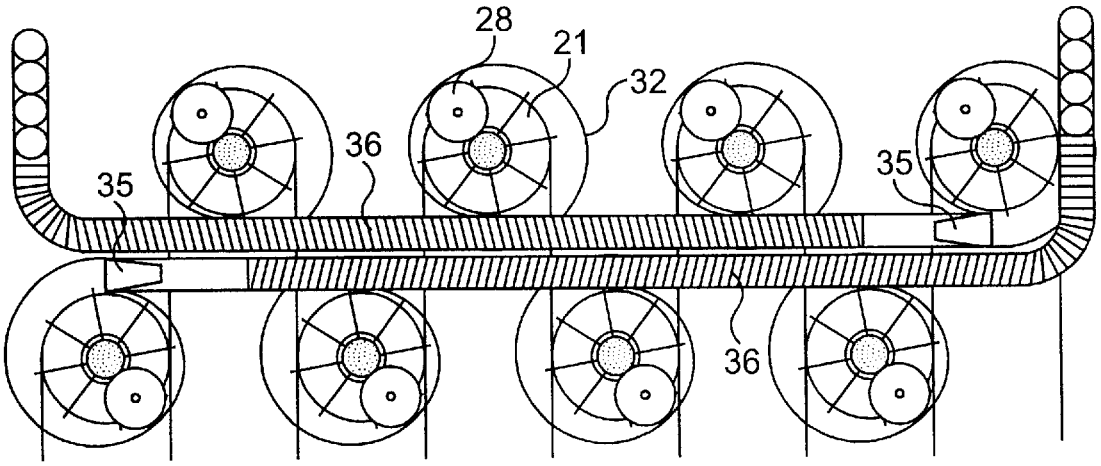
Figure 5:
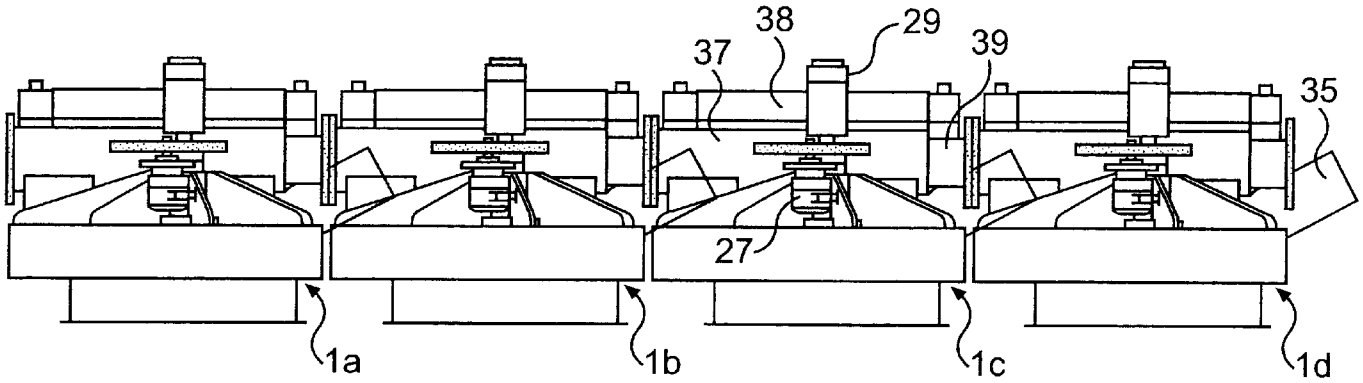
Figure 6:
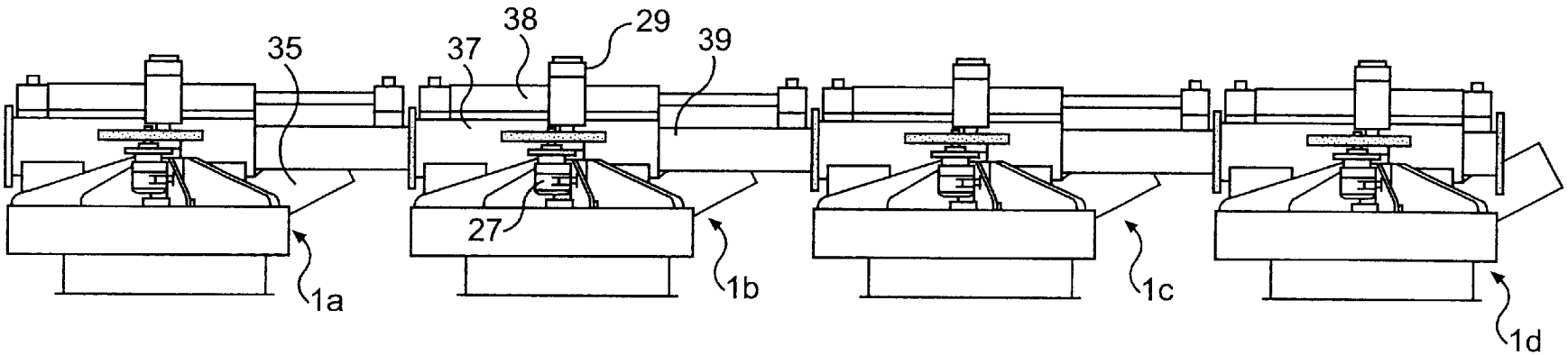

A cleaning apparatus can be provided with a plurality of such cleaning devices in order to increase the cleaning surface or to reduce the cleaning time. For example, several cleaning devices can be installed arranged either next to or behind each other on a carrier stand which can be built into a truck or a specialized vehicle. Together with corresponding high pressure systems and water recovery or water preparation equipment, this can be used to clean in this manner even greater surfaces of an environmentally appropriate and effective cleaning apparatus. It is advantageous when the cleaning apparatus has a modular construction, so that the number of the cleaning devices can be adjusted to respective requirements. This makes it possible for cleaning companies to put together an optimal cleaning apparatus on their own that will correspond to the required conditions. Since each cleaning device is provided with its own driving system, this makes it possible to prevent bottlenecks in the suction capacity when the cleaning apparatus is expanded. In order to achieve thorough cleaning also in the case of surfaces covering a large area, it is advantageous when the cleaning devices are deployed in several rows behind each other, wherein the cleaning devices in one row are arranged laterally shifted between the cleaning devices of the other row. This makes it possible to clean the entire width of an even larger region. Other special characteristics and advantages of the invention will become apparent from the following description of preferred embodiment examples based on the enclosed figures. The Figures show:

FIG. 1: an exploded view of a cleaning apparatus according to the invention;

FIG. 2: a cross-sectional view of the cleaning apparatus depicted in FIG. 1;

FIG. 3: a side view of a cleaning apparatus provided with a plurality of cleaning devices according to this invention;

FIG. 4: a top view of the cleaning apparatus shown in FIG. 3;

FIG. 5: another embodiment form of a cleaning apparatus provided with a plurality of horizontally slidable cleaning devices;

FIG. 6: the cleaning apparatus depicted in FIG. 5 shown in an extended position.

The apparatus for cleaning of a starting or landing road of an airport shown in FIG. 1 and FIG. 2 contains a housing 1, provided with a bearing bush 2, which is attached to the upper side of the housing and connected through several radial steadying struts 3 to an upper covering surface 4 of the housing 1. Inside the bearing bush 2 is mounted a driving shaft 6 provided with a central through hole 6 so that it is pivoted on an arrangement of bearings 7. The bearings arrangement 7 is provided with two bearings 8 and 9 as shown in FIG. 1, as well as with a roof packing 10 and two discs 11 and 12. On the projecting part of the driving shaft 6 on the lower end of housing 6 is attached a distributor head 13, on which are arranged laterally two U-bent washing arms 14 provided with an inner fluid delivery channel 15 through hollow connecting pieces 16. The fluid delivery channels 15 are connected with a through hole 5 via a distribution channel 17 in the distributor head 13. A nozzle insert 18 is screwed into the lower bent end of each washing arm 14. As one can see from FIG. 1, a ventilation baffle 19 which is bent upward is attached to each washing arm 14. The washing arms 14 are surrounded by a ring-shaped cover 20 which forms the lower part of the housing 1.

A fan wheel 21 is coaxially attached to the driving shaft 6 between the distributor head 13 and the upper covering surface 4 of the housing. This fan wheel 21 comprises as shown in FIG. 2 a plurality of radially arranged fan blades 22, which are attached between the upper covering plate 23 and a conically tapered lower plate 24. The fan wheel 21 is screwed to a receiving plate 25 which is connected to driving shaft 6 so as to prevent distortions.

On the end of driving shaft 6 which is projecting upward from the bearing bush 2 is mounted a strap disk 26, which is connected to the driving shaft to prevent distortions and which is driven with a belt (not shown in the figure) by a hydraulic motor 27. The pressure fluid which can be provided for example from a high-pressure pump, preferably water under high pressure, is supplied via a through hole 5 through a housing and bearing assembly 29, which is mounted on the upper end of the driving shaft 6. This makes it possible to secure supplies of a fluid that is sealed between a rotating part 20, which is connected in a fixed manner to driving shaft 6 and a stationary connecting part 31.

As one can see from FIGS. 2 and 4, the outer periphery of the fan wheel 21 and one peripheral wall 32 of the housing 1 delimits a removal channel 33, which is provided with a cross-sectional area of passage that is extended in the direction of the rotations of the fan wheel 21. At the outlet 34 is deployed a connecting piece 35, shown in FIG. 1, which is used for a flexible removal pipe or a similar component.

FIGS. 3 and 4 show a schematic view of a part of a cleaning apparatus depicting a plurality of the cleaning devices according to FIGS. 1 and 2. According to this cleaning apparatus, four respective cleaning devices are arranged in two rows deployed behind each other on a suitable carrying or driving mounting support. The cleaning devices in the rear row are laterally staggered and arranged between the cleaning device of the front row, so that a relatively wide region of the entire width can be cleaned with one pass. The cleaning devices can be easily mounted in front of a truck on a mounting support. However, they can be also integrated into any system for cleaning a horizontal surface. Moreover, the cleaning apparatus can be also provided wit a device for automatic height adjustment of individual cleaning devices enabling to set an optimal distance from these devices to a coated surface. The individual cleaning devices can be further also arranged in such a way so that they will be automatically withdrawn to the side when an obstacle is encountered. In the embodiment of the cleaning apparatus shown in FIGS. 3 and 4, a separate transport pipe is provided for each cleaning device in the form of a flexible hose, etc., so that the cleaning water can be thus carried away through this hose to a water recovery and/or preparation system. The cleaning water containing dirt particles can thus be transported separately from each of the cleaning devices through separate hoses 36 at each of the respective connecting pieces 35 to a water recovery and/or preparation system.

Effective and flexible preparations for new operations or disposal of the waste water can thus be achieved with separate transport in this manner. However, it is also possible to use a common hose or a similar suitable disposal channel instead of using separate hoses for each cleaning device.

FIGS. 5 and 6 show another embodiment example of a cleaning apparatus provided with a plurality of horizontally slidable cleaning devices. In this embodiment, housings 1*a* through 1*d* for cleaning devices arranged side by side are deployed on mounting supports 37 containing a supporting arm 39. The mounting support 37 is laterally slidable by means of a hydraulic or pneumatic cylinder 38. The mounting supports 37 of the housings 1*b* through 1*d* are attached to supporting arms 39, which can be inserted and removed telescopically of cleaning devices that are arranged to the left of the supporting arms. In the depicted embodiment, the mounting support for the housing 1*d* is attached in a stationary manner to the cleaning device which is deployed as the second housing from the right. The cleaning apparatus can thus be moved from a position between the retracted position shown in FIG. 5 up to the extended position shown in FIG. 6 with a corresponding activation of the hydraulic or pneumatic cylinder 38 on the cleaning devices having housings 1*a* through 1*c*. Thanks to this slidable arrangement, the cleaning device can be stored in the retracted position without laterally protruding parts, for instance in a trailer or a vehicle towed by a truck, and then brought out in a corresponding manner for cleaning operations. The cleaning devices are produced with a modular construction also with respect to their adjustable units, so that the cleaning apparatus can be expanded in a simple manner and its width can be easily modified or adjusted.

What is claimed is:

1. An apparatus for cleaning of a roadway, comprising:

a driving shaft;

a distributor device pivotally arranged on and rotated by the driving shaft inside a housing, wherein the distribution device is arranged to apply a high pressure fluid to a surface to be cleaned; and a fan wheel disposed inside the housing and driven by the driving shaft to produce low pressure and an air current in the housing for removal of dissolved dirt via a removal channel.

2. The apparatus according to claim 1, wherein at least one ventilation baffle is disposed in the distributor device.

3. The apparatus according to claim 2, wherein the distributor contains a distributor head deployed on a lower end of the driving shaft and provided with a plurality of washing arms, wherein a ventilation baffle is arranged on each washing arm.

4. The apparatus according to claim 2, wherein the fan wheel is mounted between an upper covering surface of the housing and the distributor device on the driving shaft so as to prevent distortion.

5. The apparatus according to claim 2, wherein the fan wheel contains a plurality of radially arranged fan blades.

6. The apparatus according to claim 1, wherein the distributor device contains a distributor head deployed on a lower end of the driving shaft and provided with a plurality of washing arms, wherein a ventilation baffle is arranged on each washing arm.

7. The apparatus according to claim 6, wherein the fan wheel is mounted between an upper covering surface of the housing and the distributor device on the driving shaft so as to prevent distortion.

8. The apparatus according to claim 6, wherein the fan wheel contains a plurality of radially arranged fan blades.

9. The apparatus according to claim 1, wherein the fan wheel is mounted between an upper covering surface of the housing and the distributor device on the driving shaft so as to prevent distortion.

10. The apparatus according to claim 9, wherein the fan wheel contains a plurality of radially arranged fan blades.

11. The apparatus according to claim 1, wherein the fan wheel contains a plurality of radially arranged fan blades.

12. The apparatus according to claim 1, wherein the removal channel is built between a peripheral wall of the housing and an outer periphery of the fan wheel.

13. The apparatus according to claim 1, wherein the removal channel is provided with a cross-sectional area of passage that is extended toward an outlet in a direction of rotations of the fan wheel.

14. The apparatus according to claim 1, wherein a connecting piece is disposed at an outlet of the removal channel.

15. The apparatus according to claim 1, wherein the driving shaft is provided with a central through hole arranged to deliver a high pressure fluid, wherein a housing and bearing assembly is disposed on an upper end of the driving shaft for connection of a stationary supply of a pressure fluid.

16. A roadway cleaning apparatus comprising:

a plurality of cleaning devices arranged in one or more rows, wherein each of the cleaning devices comprises:

a driving shaft;

a distributor device pivotally arranged on and rotated by the driving shaft inside a housing, wherein the distribution device is arranged to apply a high pressure fluid to a surface to be cleaned; and a fan wheel disposed inside the housing and driven by the driving shaft to produce low pressure and an air current in the housing for removal of dissolved dirt via a removal channel.

17. The roadway cleaning apparatus according to claim 16, wherein the cleaning devices are positioned in two rows disposed in series, wherein the rows are mutually staggered in such a way so that cleaning devices of one row are arranged between cleaning devices of another row.

18. The roadway cleaning apparatus according to claim 16, wherein each cleaning device includes a connecting piece disposed at an outlet of the removal channel, and wherein a separate removal pipeline is disposed on each connecting piece of the cleaning devices for removal of fluid and of the dissolved dirt to a water recovery or water preparation system.

19. The roadway cleaning apparatus according to claim 16, wherein the cleaning devices are horizontally displaceable via a pneumatic cylinder.

20. The roadway cleaning apparatus according to claim 19, wherein each cleaning device contains a mounting support with a supporting arm, wherein the supporting arm can be horizontally displaced by the pneumatic cylinder and can be telescopically inserted in and removed from the cleaning devices so that another cleaning device can be attached to the mounting support.

* * * * *

UNITED STATES PATENT AND TRADEMARK OFFICE

CERTIFICATE OF CORRECTION

PATENT NO. : 6,594,855 B2
DATED : July 22, 2003
INVENTOR(S) : Karl-Heinz Tomaschewski It is certified that error appears in the above-identified patent and that said Letters Patent is hereby corrected as shown below:

Title page,
Item [73], Assignee, please delete "Heretsreid-Umwetec GmbH & Co. KG, Lauterbrunn (DE)" and insert -- umwetec GmbH & Co. KG, Heretsried-Lauterbrunn (DE) --.

Signed and Sealed this

Thirtieth Day of March, 2004

JON W. DUDAS
*Acting Director of the United States Patent and Trademark Office*